US005865980A

United States Patent [19]

Ray et al.

[11] Patent Number: 5,865,980

[45] Date of Patent: Feb. 2, 1999

[54] ELECTROLYSIS WITH A INERT ELECTRODE CONTAINING A FERRITE, COPPER AND SILVER

[75] Inventors: Siba P. Ray, Murrysville; Robert W. Woods, New Kensington; Robert K. Dawless, Monroeville; Robert B. Hosler, Sarver, all of Pa.

[73] Assignee: Aluminum Company of America, Pittsburgh, Pa.

[21] Appl. No.: 883,061

[22] Filed: Jun. 26, 1997

[51] Int. Cl.[6] ..... C25C 3/06; C25C 3/00; C25B 11/04

[52] U.S. Cl. ..... 205/367; 205/387; 205/395; 204/243 R; 204/293

[58] Field of Search ..... 204/293, 243 R; 205/395, 367, 387

[56] References Cited

U.S. PATENT DOCUMENTS

| | | | |
|---|---|---|---|
| 3,996,117 | 12/1976 | Graham et al. | 204/67 |
| 4,620,905 | 11/1986 | Tarcy et al. | 204/64 |
| 5,019,225 | 5/1991 | Darracq et al. | 204/67 |
| 5,626,914 | 5/1997 | Ritland et al. | 427/377 |

*Primary Examiner*—Kathryn Gorgos
*Assistant Examiner*—Edna Wang
*Attorney, Agent, or Firm*—Glenn E. Klepac

[57] ABSTRACT

An inert electrode material is made by reacting at an elevated temperature a mixture preferably comprising iron oxide, at least one other metal oxide, copper and silver. The reaction produces a material having ceramic phase portions and alloy phase portions, wherein the alloy phase portions have copper-rich interior portions and silver-rich exterior portions. Inert anodes made with a reaction mixture containing copper and silver have lower wear rates than inert anodes made with copper and no silver.

16 Claims, 3 Drawing Sheets

ELECTROLYSIS WITH A INERT ELECTRODE CONTAINING A FERRITE, COPPER AND SILVER

FIELD OF THE INVENTION

The present invention relates to the electrolytic production of metals such as aluminum. More particularly, the invention relates to electrolysis in a cell having an inert electrode comprising a ferrite, copper and silver. As used herein, the term "ferrite" refers to a mixed metal oxide compound containing ferric oxide and at least one other metal oxide.

BACKGROUND OF THE INVENTION

The energy and cost efficiency of aluminum smelting can be significantly reduced with the use of inert, non-consumable and dimensionally stable anodes. Replacement of traditional carbon anodes with inert anodes should allow a highly productive cell design to be utilized, thereby reducing capital costs. Significant environmental benefits are also possible because inert anodes produce no $CO_2$ or $CF_4$ emissions. The use of a dimensionally stable inert anode together with a wettable cathode also allows efficient cell designs and a shorter anode-cathode distance, with consequent energy savings.

The most significant challenge to the commercialization of inert anode technology is the anode material. Researchers have been searching for suitable inert anode materials since the early years of the Hall-Heroult process. The anode material must satisfy a number of very difficult conditions. For example, the material must not react with or dissolve to any significant extent in the cryolite electrolyte. It must not react with oxygen or corrode in an oxygen-containing atmosphere. It should be thermally stable at temperatures of about 1000° C. It must be relatively inexpensive and should have good mechanical strength. It must have electrical conductivity greater than 120 $ohm^{-1}$ $cm^{-1}$at the smelting cell operating temperature about 950°–970° C. In addition, aluminum produced with the inert anodes should not be contaminated with constituents of the anode material to any appreciable extent.

A principal objective of our invention is to provide an efficient and economic process for making an inert electrode material, starting with a reaction mixture comprising iron oxide, at least one other metal oxide, copper and silver.

A related objective of our invention is to provide a novel inert electrode comprising ceramic phase portions and alloy phase portions wherein interior portions of the alloy phase portions contain more copper than silver and exterior portions of the alloy phase portions contain more silver than copper.

Some other objectives of our invention are to provide an electrolytic cell and an electrolytic process for producing metal, utilizing the novel inert electrode of the invention.

Additional objectives and advantages of our invention will occur to persons skilled in the art from the following detailed description thereof.

SUMMARY OF THE INVENTION

The present invention relates to a process for making an inert electrode and to an electrolytic cell and an electrolytic process for producing metal utilizing the inert electrode. Inert electrodes containing the composite material of our invention are useful in producing metals such as aluminum, lead, magnesium, zinc, zirconium, titanium, lithium, calcium, silicon and the like, generally by electrolytic reduction of an oxide or other salt of the metal.

In accordance with our invention, a reaction mixture is reacted in a gaseous atmosphere at an elevated temperature. The reaction mixture comprises particles containing oxides of at least two different metals and an alloy or mixture of copper and silver. The oxides are preferably iron oxide and at least one other metal oxide which may be nickel, tin, zinc, yttrium or zirconium oxide. Nickel oxide is preferred. Mixtures and alloys of copper and silver containing up to about 30 wt. % silver are preferred. The silver content is preferably about 2–30 wt. %, more preferably about 4–20 wt. %, and optimally about 5–10 wt. %, remainder copper. The reaction mixture preferably contains about 50–90 parts by weight of the metal oxides and about 10–50 parts by weight of the copper and silver.

The alloy or mixture of copper and silver preferably comprises particles having an interior portion containing more copper than silver and an exterior portion containing more silver than copper. More preferably, the interior portion contains at least about 70 wt. % copper and less than about 0 wt. % silver, while the exterior portion contains at least about 50 wt. % silver and less than about 30 wt. % copper. Optimally, the interior portion contains at least about 90 wt. % copper and less than about 10 wt. % silver, while the exterior portion contains less than about 10 wt. % copper and at least about 50 wt. % silver. The alloy or mixture may be provided in the form of copper particles coated with silver. The silver coating may be provided, for example, by electrolytic deposition or by electroless deposition.

The reaction mixture is reacted at an elevated temperature in the range of about 750°–1500° C., preferably about 1000°–1400° C. and more preferably about 1300°–1400° C. In a particularly preferred embodiment, the reaction temperature is about 1350° C.

The gaseous atmosphere contains about 5–3000 ppm oxygen, preferably about 5–700 ppm and more preferably about 10–350 ppm. Lesser concentrations of oxygen result in a product having a larger metal phase than desired, and excessive oxygen results in a product having too much of the phase containing metal oxides (ferrite phase). The remainder of the gaseous atmosphere preferably comprises a gas such as argon that is inert to the metal at the reaction temperature.

In a preferred embodiment, about 1–10 parts by weight of an organic polymeric binder are added to 100 parts by weight of the metal oxide and metal particles. Some suitable binders include polyvinyl alcohol, acrylic polymers, polyglycols, polyvinyl acetate, polyisobutylene, polycarbonates, polystyrene, polyacrylates, and mixtures and copolymers thereof. Preferably, about 3–6 parts by weight of the binder are added to 100 parts by weight of the metal oxides, copper and silver.

Inert anodes made by the process of our invention have ceramic phase portions and alloy phase portions or metal phase portions. The ceramic phase portions may contain both a ferrite such as nickel ferrite or zinc ferrite, and a metal oxide such as nickel oxide or zinc oxide. The alloy phase portions are interspersed among the ceramic phase portions. At least some of the alloy phase portions include an interior portion containing more copper than silver and an exterior portion containing more silver than copper.

Inert electrodes made in accordance with our invention are preferably inert anodes useful in electrolytic cells for metal production operated at temperatures in the range of about 750°–1080° C. A particularly preferred cell operates at a temperature of about 900°–980° C., preferably about 950°–970° C. An electric current is passed between the inert anode and a cathode through a molten salt bath comprising an electrolyte and an oxide of the metal to be collected. In a preferred cell for aluminum production, the electrolyte comprises aluminum fluoride and sodium fluoride and the metal oxide is alumina. The electrolyte may also contain calcium fluoride and/or lithium fluoride.

DETAILED DESCRIPTION OF A PREFERRED EMBODIMENT

Figure 1:
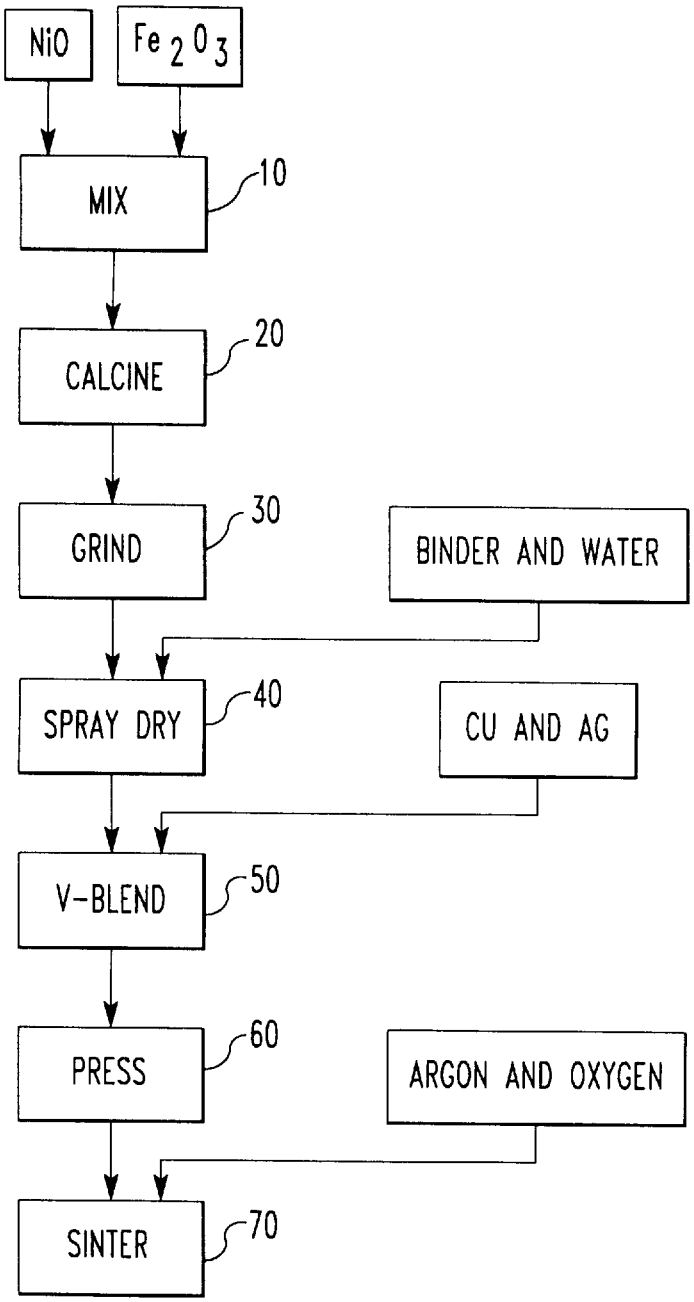
FIG. 1 is a flowsheet diagram of a process for making in inert electrode in accordance with the present invention.

In the embodiment diagrammed in FIG. 1 the process of our invention starts by blending NiO and $Fe_2O_3$ powders in a mixer 10. Optionally, the blended powders may be ground to a smaller size before being transferred to a furnace 20 where they are calcined for 12 hours at 1250° C. The calcination produces a mixture having nickel ferrite spinel and NiO phases.

The mixture is sent to a ball mill 30 where it is ground to an average particle size of approximately 10 microns. The fine particles are blended with a polymeric binder and water to make a slurry in a spray dryer 40. The slurry contains about 60 wt. % solids and about 40 wt. % water. Spray drying the slurry produces dry agglomerates that are transferred to a V-blender 50 and there mixed with copper and silver powders.

The V-blended mixture is sent to a press 60 where it is isostatically pressed, for example at 20,000 psi, into anode shapes. The pressed shapes are sintered in a controlled atmosphere furnace 70 supplied with an arcon-oxygen gas mixture. The furnace 70 is typically operated at 1350°–1385° C. for 2–4 hours. The sintering process burns out polymeric binder from the anode shapes.

The starting material in one embodiment of our process is a mixture of copper powder and silver powder with a metal oxide powder containing about 51.7 wt.% NiO and about 48.3 wt. % $Fe_2O_3$. The copper powder normally has a 10 micron particle size and possesses the properties shown in Table 1.

TABLE 1

Physical and Chemical Analysis of Cu Powder

| | Particle Size (microns) |
|---|---|
| 90% less than | 27.0 |
| 50% less than | 16.2 |
| 10% less than | 7.7 |

Spectrographic Analysis Values accurate to a factor of ±3

| Element | Amount (wt. %) |
|---|---|
| Ag | 0 |
| Al | 0 |
| Ca | 0.02 |
| Cu | Major |
| Fe | 0.01 |
| Mg | 0.01 |
| Pb | 0.30 |

TABLE 1-continued

Physical and Chemical Analysis of Cu Powder

| | |
|---|---|
| Si | 0.01 |
| Sn | 0.30 |

Figure 2:
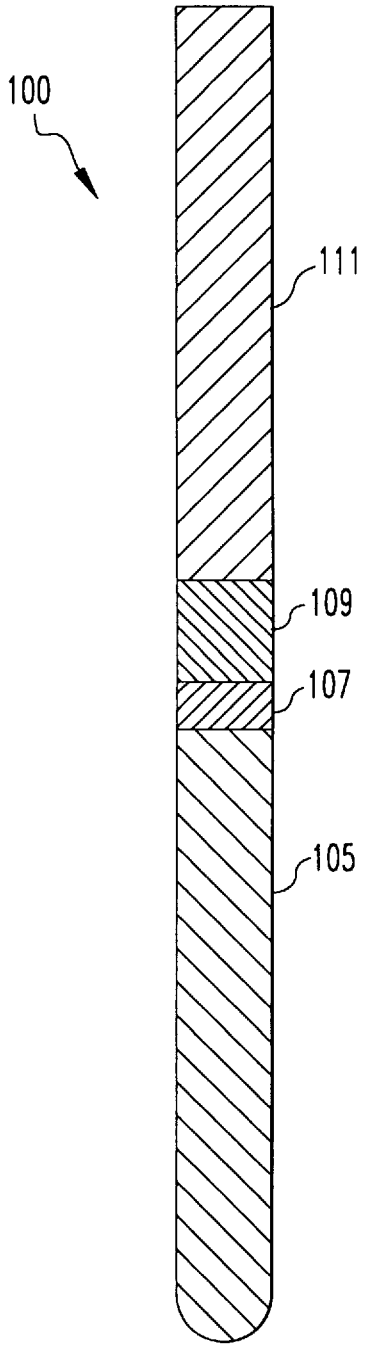
FIG. 2 is a schematic illustration of an inert anode made in accordance with the present invention.

About 83 parts by weight of the NiO and $Fe_2O_3$ powders are combined with 17 parts by weight of the copper and silver powder. As shown in FIG. 2, an inert anode 100 of the present invention includes a cermet end 105 joined successively to a transition region 107 and a nickel end 109. A nickel or nickel-chromium alloy rod 111 is welded to the nickel end 109. The cermet end 105 has a length of 96.25 mm, the transition region 107 is 7 mm long and the nickel end 109 is 12 mm long. The transition region 107 includes four layers of graded composition, ranging from 25 wt. % Ni adjacent the cermet end 105 and then 50, 75 and 100 wt. % Ni, balance the mixture of NiO, $Fe_2O_3$ and copper and silver powders described above.

The anode 10 is then pressed at 20,000 psi and sintered in an atmosphere containing argon and oxygen.

We made eight test anodes containing 17 to 27 wt. % of a mixture of copper and silver powders, balance an oxide powder mixture containing 51.7 wt. % NiO and 48.3 wt. % $Fe_2O_3$. The copper-silver mixture contained either 98 wt. % copper and 2 wt. % silver or 70 wt. % copper and 30 wt. % silver. The porosities and densities of these test anodes are shown below in Table 2.

TABLE 2

Test Anode Porosity and Density

| Anode Composition | Apparent Porosity (%) | Density ($g/cm^3$) |
|---|---|---|
| 17% (98 Cu—2 Ag) | 0.151 | 6.070 |
| 17% (70 Cu—30 Ag) | 0.261 | 6.094 |
| 22% (98 Cu—2 Ag) | 0.230 | 6.174 |
| 22% (70 Cu—30 Ag) | 0.321 | 6.157 |
| 25% (98 Cu—2 Ag) | 0.411 | 6.230 |
| 25% (70 Cu—30 Ag) | 0.494 | 6.170 |
| 27% (98 Cu—2 Ag) | 0.316 | 6.272 |
| 27% (70 Cu—30 Ag) | 0.328 | 6.247 |

These anodes were tested for 7 days at 960° C. in a molten salt bath having an $AlF_3$/NaF ratio of 1.12, along with anodes containing 17 wt. % copper only and 83 wt. % of the NiO and $Fe_2O_3$ mixture. At the end of the test, a microscopic examination found that the silver-containing samples had significantly less corrosion and metal phase attack than samples containing copper only. We also observed that samples containing the 70 Cu—30 Ag alloy performed better than samples made with the 98 Cu—2 Ag alloy.

Microscopic examination of the samples made with 70 Cu—30 Ag alloy showed a multiplicity of alloy phase portions or metal phase portions interspersed among ceramic phase portions. Surprisingly, the alloy phase portions each had an interior portion rich in copper surrounded by an exterior portion rich in silver. In one sample made with 14 wt. % silver 7 wt. % copper, 40.84 wt. % NiO and 38.16 wt. % $Fe_2O_3$, a microprobe x-ray analysis revealed the following metal contents in one alloy phase portion.

TABLE 3

| Contents of Alloy Phase | Metal Content (wt. %) | | | |
|---|---|---|---|---|
| | Ag | Cu | Fe | Ni |
| Interior portion | 3.3 | 72 | 0.8 | 23 |
| Exterior portion | 90+ | 6 | 1.5 | 1.7 |

Figure 3:
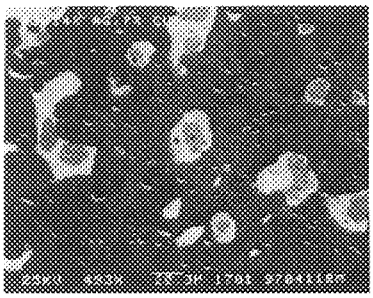
FIGS. 3–7 are x-ray microphotographs of an inert electrode of the invention.

An anode made with 14 wt. % silver, 7 wt. % copper, 40.84 wt. % NiO and 38.16 wt. % $Fe_2O_3$ was cross-sectioned for x-ray analysis. An x-ray backscatter image taken at 493× is shown in FIG. 3. Several lighter colored metal phase portions or alloy phase portions are seen scattered in a ceramic matrix.

Figure 4:
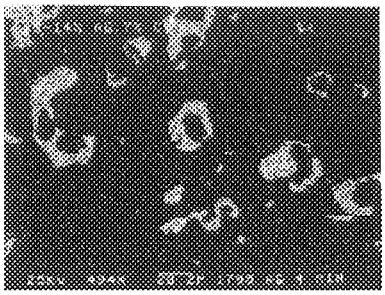
Figure 5:
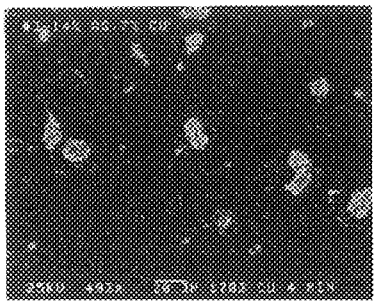
Figure 6:
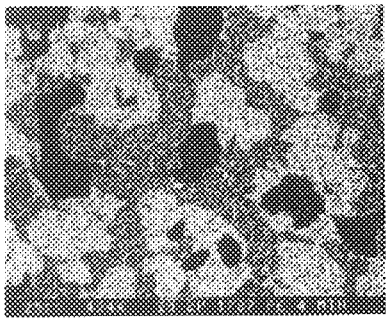
Figure 7:
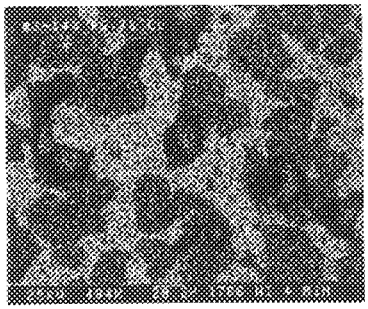

FIGS. 4, 5, 6 and 7 show x-ray images for Ag, Cu, Fe and Ni, respectively, in the FIG. 3 anode section. FIG. 4 shows that the metal phase portions include light exterior portions containing more silver than copper, generally surrounding darker interior portions containing more copper than silver. FIG. 5 shows interior portions of the metal phase portions as lighter areas containing more copper than silver. FIG. 6 shows that both interior and exterior portions of the metal phase portions contain very little iron. FIG. 7 shows higher concentrations of nickel in interior portions of some metal phases than in the exterior portions.

We also fabricated and tested some anode samples containing 17 and 22 wt. % metal, balance NiO and $Fe_2O_3$. Three different metals were used—all Cu, 98 Cu—2 Ag and 70 Cu—30 Ag. The samples were used for electrolysis of alumina in a bench size cell containing a molten salt bath having $AlF_3$/NaF bath ratios of 1.07 to 1.22. Cell temperature was approximately 960° C. Test sample wear was measured after each test concluded.

TABLE 4

| Test Anode Wear Rates | | | | |
|---|---|---|---|---|
| Run Order | Ag Content (wt. %) | Run Time (hr.) | Bath Ratio | Wear Rate (in./yr.) |
| 1 | 2 | 22.8 | 1.22 | 5.46 |
| 2 | 0 | 7.6 | 1.22 | 6.34 |
| 3 | 30 | 20.1 | 1.07 | 1.92 |
| 4 | 0 | 20.9 | 1.1 | 3.54 |
| 5 | 30 | 21.9 | 1.07 | 1.6 |
| 6 | 2 | 20.6 | 1.07 | 2.13 |

These test results showed lower wear rates for anodes containing some silver than for anodes containing no silver. Test anodes made with 30 wt. % silver and 70 wt. % copper had the lowest wear rates.

We have discovered that sintering anode compositions in an atmosphere of controlled oxygen content lowers the porosity to acceptable levels and avoids bleed out of the metal phase. The atmosphere we used in tests with a mixture containing 83 wt. % NiO and $Fe_2O_3$ powders and 17 wt. % copper powder was predominantly argon, with controlled oxygen contents in the range of 17 to 350 ppm. The anodes were sintered in a Lindbergh tube furnace at 1350° C. for 2 hours. We found that anode compositions sintered under these conditions always had less than 0.5% porosity, and that density was approximately 6.05 g/cm$^3$ when the compositions were sintered in argon containing 70–150 ppm oxygen. In contrast, when the same anode compositions were sintered for the same time and at the same temperature in an argon atmosphere, porosities ranged from about 0.5 to 2.8% and the anodes showed various amounts of bleed out of the copper-rich metal phase.

We also discovered that nickel and iron contents in the metal phase of our anode compositions can be controlled by adding an organic polymeric binder to the sintering mixture. Some suitable binders include polyvinyl alcohol (PVA), acrylic acid polymers, polyglycols such as polyethylene glycol (PEG), polyvinyl acetate, polyisobutylenes, polycarbonates, polystyrenes, polyacrylates and mixtures and copolymers thereof.

A series of tests was performed with a mixture comprising 83 wt. % of metal oxide powders and 17 wt. % copper powder. The metal oxide powders were 51.7 wt. % NiO and 48.3 wt. % $Fe_2O_3$. Various percentages of organic binders were added to the mixture, which was then sintered in a 90 ppm oxygen-argon atmosphere at 1350° C. for 2 hours. The results are shown in Table 5.

TABLE 5

| Effect of Binder Content on Metal Phase Composition | | | | | |
|---|---|---|---|---|---|
| | | | Metal Phase Composition | | |
| | Binder | Binder Content (wt. %) | Fe (wt. %) | Ni (wt. %) | Cu (wt. %) |
| 1 | PVA | 1.0 | 2.16 | 7.52 | 90.32 |
| | Surfactant | 0.15 | | | |
| 2 | PVA | 0.8 | 1.29 | 9.2 | 89.5 |
| | Acrylic Polymers | 0.6 | | | |
| 3 | PVA | 1.0 | 1.05 | 10.97 | 87.99 |
| | Acrylic Polymers | 0.9 | | | |
| 4 | PVA | 1.1 | 1.12 | 11.97 | 86.91 |
| | Acrylic Polymers | 0.9 | | | |
| 5 | PVA | 2.0 | 1.51 | 13.09 | 85.40 |
| | Surfactant | 0.15 | | | |
| 6 | PVA | 3.5 | 3.31 | 32.56 | 64.13 |
| | PEG | 0.25 | | | |

The test results in Table 5 show that selection of the nature and amount of binder in the mixture can be used to control composition of the metal phase in the cermet. We prefer a binder containing PVA and either a surfactant or acrylic powder in order to raise the copper content of the metal phase. A high copper content is desirable in the metal phase because nickel anodically corrodes during electrolysis.

Having thus described the invention, what is claimed is:

1. An inert electrode suitable for use in production of a metal by electrolytic reduction of a metal compound, said inert electrode comprising a product obtained by reacting at an elevated temperature in contact with oxygen a mixture comprising:

(a) particles of at least two metal oxides selected from the group consisting of iron, nickel, tin, zinc, yttrium and zirconium oxides; and (b) an alloy or mixture containing about 2–30 wt. % silver and about 70–98 wt. % copper, and wherein said inert electrode comprises at least one ceramic phase portion comprising iron oxide and at least one other metal oxide selected from the group consisting of nickel, tin, zinc, yttrium and zirconium oxides, and a plurality of alloy phase portions comprising copper and silver, at least some of said alloy phase portions including an interior portion containing more copper than silver and an exterior portion containing more silver than copper.

2. The electrode of claim 1 wherein said interior portion contains less than about 30 wt. % silver and said exterior portion contains less than about 30 wt. % copper.

3. The electrode of claim 1 wherein said alloy or mixture comprises particles having an interior portion containing at least about 70 wt. % copper and an exterior portion containing at least about 50 wt. % silver.

4. The electrode of claim 1 wherein said other metal oxide comprises nickel oxide.

5. The electrode of claim 1 wherein said reaction mixture further comprises:

(c) an organic polymeric binder.

6. The electrode of claim 5 wherein said reaction mixture comprises about 50–90 parts by weight of the iron oxide and other metal oxide, about 10–50 parts by weight of the alloy or mixture and about 2–10 parts by weight of the binder.

7. An electrolytic cell for producing metal in a process wherein oxygen is evolved, comprising:

(a) a molten salt bath comprising an electrolyte and an oxide of a metal to be collected;

(b) a cathode; and (c) an anode comprising the inert electrode of claim 1.

8. An electrolytic process for producing metal by passing an electric current between an inert anode and a cathode through a molten salt bath comprising an electrolyte and an oxide of a metal, said electric current producing oxygen at the inert anode and a metal at the cathode, said inert anode comprising the inert electrode of claim 1.

9. The process of claim 8 wherein said electrolyte comprises aluminum fluoride and sodium fluoride and said oxide comprises alumina.

10. The process of claim 9 wherein said electrolyte further comprises calcium fluoride.

11. The process of claim 9 wherein said electrolyte further comprises lithium fluoride.

12. The process of claim 9 wherein said process is performed in a cell having an operating temperature in the range of about 750°–1080° C.

13. The process of claim 9 wherein said metal oxides comprise iron oxides and at least one other metal oxide selected from the group consisting of nickel, tin, zinc, yttrium and zirconium oxides.

14. The electrode of claim 1 wherein said alloy or mixture contains about 4–20 wt. % silver, remainder copper.

15. The electrode of claim 1 wherein said alloy or mixture contains about 5–10 wt. % silver, remainder copper.

16. An inert anode suitable for use in production of aluminum by electrolytic reduction of alumina in a molten salt bath, said inert anode being made by pressing into an anode shape and then reacting at an elevated temperature in contact with oxygen a mixture comprising:

(a) particles comprising nickel and iron oxides; and (b) an alloy or mixture containing about 2–30 wt. % silver and about 70–98 wt. % copper;

said inert anode comprising at least one ceramic phase portion comprising nickel and iron oxides and a plurality of alloy phase portions comprising copper and silver, at least some of said alloy phase portions including an interior portion containing more copper than silver and an exterior portion containing more silver than copper.

* * * * *

UNITED STATES PATENT AND TRADEMARK OFFICE

CERTIFICATE OF CORRECTION

PATENT NO. : 5,865,980

DATED : February 2, 1999

INVENTOR(S) : S.P. Ray, R.W. Woods, R.K. Dawless, R.B. Hosler

It is certified that error appears in the above-identified patent and that said Letters Patent is hereby corrected as shown below:

| | |
|---|---|
| Col. 1, immediately following title | Insert the following paragraph: |

--This invention was made with Government support under Contract No. DE-FC07-ioID12848 awarded by the United States Department of Energy. The Government has certain rights in this invention.--

Signed and Sealed this

Twenty-second Day of May, 2001

*Attest:*

Nicholas P. Godici

NICHOLAS P. GODICI

*Attesting Officer*

*Acting Director of the United States Patent and Trademark Office*